United States Patent [19]

Suzuki

[11] Patent Number: 4,463,329

[45] Date of Patent: Jul. 31, 1984

[54] DIELECTRIC WAVEGUIDE

[76] Inventor: Hirosuke Suzuki, Ohta-Ku, Tokyo, Japan, 105

[21] Appl. No.: 339,631

[22] Filed: Jan. 15, 1982

Related U.S. Application Data

[63] Continuation of Ser. No. 933,848, Aug. 15, 1978, abandoned.

[51] Int. Cl.[3] ..... H01P 3/00

[52] U.S. Cl. ..... 333/239; 29/600

[58] Field of Search ..... 428/316.6, 421, 422, 428/36, 64, 373, 377, 379, 910; 350/96.1; 333/239, 242; 29/600

[56] References Cited

U.S. PATENT DOCUMENTS

| | | | |
|---|---|---|---|
| 3,331,721 | 7/1967 | Horst | 156/250 |
| 3,953,566 | 4/1976 | Gore | 264/175 |
| 4,154,892 | 5/1979 | Glatti et al. | 428/375 |
| 4,283,448 | 8/1981 | Bowman | 428/36 |

*Primary Examiner*—James J. Bell

*Attorney, Agent, or Firm*—Mortenson & Uebler

[57] ABSTRACT

A dielectric waveguide in cable form fabricated from polytetrafluoroethylene. An embodiment of cable is a composite of partially sintered PTFE and sintered and unsintered expanded PTFE arranged in such a fashion that the specific gravity of cable decreases from the core to the outer surface.

21 Claims, 5 Drawing Figures

DIELECTRIC WAVEGUIDE

This application is a continuation of U.S. Pat. Ser. No. 933,848, filed Aug. 15, 1978, now abandoned.

FIELD OF THE INVENTION

The invention relates to a dielectric waveguide or surface wave transmission line. The dielectric waveguide can convey high frequency signals in the range 30–1,000 GHz with little or no dissipation. The dielectric waveguide can also be used as a dielectric image line.

BACKGROUND OF THE INVENTION

Electromagnetic waves in the milli, submilli or light wave region are conveyed through transmission lines in a dielectric mode, a surface wave mode, a wave-guide mode or in any combination thereof. Such transmission lines utilize dielectric materials either partially or entirely as the medium for conveying the electromagnetic waves described above.

Conventional dielectric materials for conveying the electromagnetic waves include polyethylene, polypropylene and polytetrafluoroethylene. Examples of materials having low dielectric constants useful for surrounding these materials included foamed plastics including polyethylene and polypropylene. Such materials have numerous discrete bubbles created by the foaming agent. A problem with these foamed plastics is that some of the foaming agent remains causing disadvantages, such as increased dielectric loss, difficulty in controlling dielectric constant differences in degree of foaming especially at boundary areas, difficulty in forming bubbles with diameters less that several fractions (1/5–1/6 $\gamma$) of the wave length to be transmitted and difficulty in fabrication of the cable. These foamed materials have not, therefore, found uses as materials for surrounding or jacketing dielectrics.

BRIEF DESCRIPTION OF THE INVENTION

The dielectric waveguide of this invention is fabricated from sintered or partially sintered polytetrafluoroethylene (PTFE) or a crystalline microporous polymer having a microstructure of nodes interconnected by fibrils. The waveguide can be fabricated from either of the above materials alone or in combination, and the crystalline polymer may be PTFE. PTFE has a low dielectric constant and tan $\delta$, can be made flexible and easily fabricated into any desired shape and permittivity.

DETAILED DESCRIPTION OF THE INVENTION

The unsintered or partially sintered PTFE articles to be used as at least a portion of the dielectric waveguide or junction of this invention is produced as follows: commercially available PTFE fine powder and/or coagulated PTFE dispersion is mixed with a liquid lubricant in a weight ratio of approximately 80:20 PTFE to lubricant. The lubricant to be used must wet the PTFE and be volatile at temperatures below the crysalline melt point of PTFE. Examples include liquid hydrocarbons such as kerosene, solvent naphtha, etc.; aromatic hydrocarbons such as toluene, xylene, etc.; alcohols; water containing surfactants, etc. The lubricated PTFE mixture is then preformed into a cylinder by moderate pressure. This preform is then placed in a ram extruder and extruded through a die whose cross-section can be varied as required. The PTFE lubricant mixture is greatly sheared during the extrusion process and a portion of the PTFE particles are elongated lengthwise and tangled together to give an extrudate with some longitudinal strength. The extrudate, now in sheet form, is calendared thereby increasing its strength and density. The lubricant is then removed usually by raising the calendared extrudate above the boiling point of the lubricant leaving an unsintered PTFE article. This article contains many fine particles, some of which have been oriented in the direction of extrusion. The properties of this article are: specific gravity 1.45–1.8; relative permittivity 1.6–1.9 at 10 GHz; tan $\delta 2\times10^{-5}-1\times10^{-4}$ also at 10 GHz; and a porosity of 18–32%.

The above properties can be controlled, in part, by adjusting the die design; and/or the reduction ratio. The properties can further be altered by heating the calendared extrudate above its crystalline melt point, i.e., sintering. On heating above say 370 degrees C., the PTFE particles and fibrils making up the calendared extrudate coalesce, the void spaces disappear to give a solid mass having a specific gravity of about 2.2. In the present invention, the sintering is not complete; the heating above the crystalline melt point is controlled to produce a PTFE product with a specific gravity of about 1.9. The means of heating used is infrared and/or far-infrared rays. By focusing these rays in the center of the extruded product when in say rod form, the relative permittivity of the product can be decreased from the center to the exterior.

Figure 1:
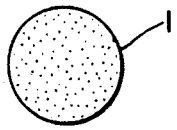
FIG. 1 and FIG. 2 are cross-sectional views of embodiments of this invention.
Figure 2:
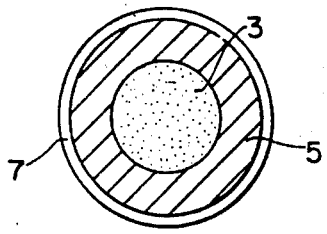

FIG. 1 shows the cross section of an unsintered PTFE rod, 3 mm in diameter 1,000 mm in length and 1.6 specific gravity. From one end of this rod an electromagnetic wave with a frequency of 100 GHz is applied using a conical horn, the attenuation measured at the other end being 0.4 dB/m. This value is lower than that of fully sintered PTFE, which has been the best previous material with an attenuation of 2.9 dB/m. FIG. 2 shows a PTFE rod 3 which has partially sintered in a constant temperature chamber set at 350 degrees C. for 5 minutes. Over this rod is wrapped an unsintered PTFE tape 5, 0.2 mm in thickness, 20 mm in width and a specific gravity of 1.6 to form a wrapped rod with an outside diameter of 15 mm. The tape wrapped rod is then covered with a 1 mm PVC jacket 7 to provide an electromagnetic shield and to act as a reinforcement. This complete waveguide had a dissipation under the conditions described above of 0.5 dB/m.

The unsintered PTFE used in the above two embodiments is porous and subject to plastic deformity under appropriate pressure, thus, the volume change of this material due to temperature is smaller than that of sintered solid PTFE. The unsintered material has almost zero change in dielectric constant with changing temperature. This material can also be employed as an insulating material in a resonator, branching filter, etc. Moreover, since the unsintered PTFE is porous it can absorb various gases, vapors and liquids which wet PTFE such as hydrocarbons (e.g., gasoline, kerosene, heavy oil, etc.), ketones, alcohols, etc. This material can be used as the core and/or the jacketing material of a waveguide, a resonator or a branching filter.

These devices can be used for liquid leak detecting. When the devices come in contact with wetting fluids, these fluids permeate the PTFE structure producing wave reflection or absorption, change in propogation delay, crosstalk or attenuation. The dielectric waveguide shown in FIG. 2 showed a zero output when the PVC jacket was removed from a 10 cm portion in the middle of the waveguide and this portion was dipped in gasoline. No output change was detected when the above guide with exposed portion was dipped in water. The unsintered or partially sintered PTFE can also be used as a dielectric in conjunction with a metal waveguide. Although the above embodiments have been described in terms of a dielectric waveguide having a round cross-section, other arbitrary cross-sectional shapes are possible.

A crystalline polymer with a microstructure of nodes interconnected fibrils can be used at least as a portion of a dielectric waveguide. Examples of this crystalline porous polymer include PTFE and PTFE plus small amounts of additives such as copolymers of tetrafluoroethylene and hexafluoropropylene (FEP) and/or extractable fillers such as silicates, carbonates, metals, metal oxides, sodium chloride, ammonium chloride, starch powders, etc. Other examples of crystalline porous polymers include polyolefins such as polyethylene, polypropylene, etc.

An explanation will be made below of a process of manufacturing a crystalline porous polymer with a microstructure of nodes interconnected by fibrils; PTFE will be used as an example. The useful materials, however, are not limited to PTFE.

The unsintered PTFE described above acts as the precursor for porous PTFE with a microstructure of nodes interconnected by fibrils. This precursor is stretched in at least one direction at a stretch ratio ranging from 1 to 100 fold according to the teachings of U.S. Pat. No. 3,953,566. By changing the stretch ratio, the specific gravity, porosity, dielectric constant, etc. of the expanded PTFE can be varied in a wide range. This permits the easy selection of waveguide material having the desired electromagnetic wave transmission. The expanded PTFE may be heat set by bringing the temperature to above 250 degrees C. but below the crystalline melt point or sintered by heating above the crystalline melt point say between 360–375 degrees C. for 1–15 minutes. The PTFE is restrained to prevent shrinkage during the heat setting or sintering steps. By controlling the extent of the heat setting and/or sintering the dielectric constant of the material can be altered.

The resultant PTFE has the following properties: porosity 30–90% (preferably 60–80%) mean pore size 0.01–50 m, air permeability 100–5,000 $cm^2$/min. (amount of air per unit time to pass through 2.54 cm long tube wall under a pressure of 1 psig.), a water entry pressure of 0.1–1.5 kg/cm and a relationship between stretch ratio, specific gravity and relative permittivity ($\epsilon r$) and tan $\delta$ as follows:

| Stretch Ratio | 1 | 2 | 10 |
|---|---|---|---|
| Specific Gravity | 1.6 | 0.8 | .08 |
| Er (at 10 Hz) | 1.71 | 1.31 | 1.07 |

-continued

| Stretch Ratio | 1 | 2 | 10 |
|---|---|---|---|
| tan $\delta$ (at $10^6$ Hz) | $7 \times 10^{-5}$ | $3 \times 10^{-5}$ | $1 \times 10^{-5}$ |

The material can be provided as a tube having an inside diameter a little larger than the outside diameter of a PTFE core as described above. The tube snuggly fits over the PTFE core and the resultant assembly is so heated so as to shrink the outside dielectric to produce a bonded two-layer dielectric.

Figure 3:
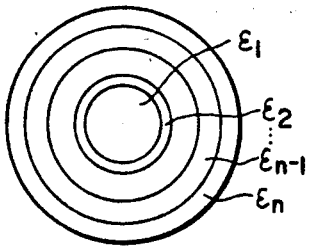
FIG. 3 is an explanatory cross-sectional view of an embodiment of this invention illustrating the variance in relative permittivity.

FIG. 3 is a schematic view of a dielectric waveguide of the present invention. In FIG. 3, the $\eta$th layer is produced by tape wrapping and/or enveloping. The dielectric constant of each dielectric layer (i.e., $\epsilon_1$, $\epsilon_2$, $\epsilon_3$ . . . $\epsilon_\eta$) decreases from the center to the outside; the center to the outside; the reverse can be, of course, achieved. Where the dielectric is one body, a dielectric gradient can be produced by, for example, focusing infrared and/or far-infrared rays. A metal layer can optionally be fitted over the dielectric.

Figure 4:
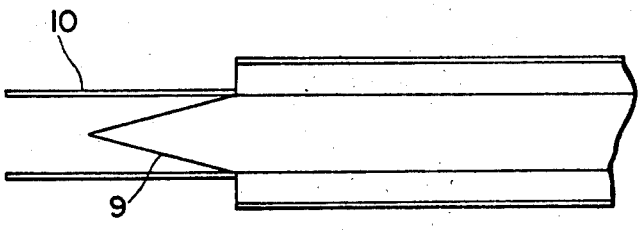
FIG. 4 and FIG. 5 are longitudinal sections of embodiments of this invention.

FIG. 4 is a longitudinal section of a junction part of an embodiment of the present invention, by which the waveguide is connected without mismatching to another waveguide. An end portion 9 of either sintered solid PTFE or a porous crystalline polymer, is shaped into a cone by pressure, formation or cutting the left end of the junction and is then connected, for example, to a metal waveguide 10.

Figure 5:
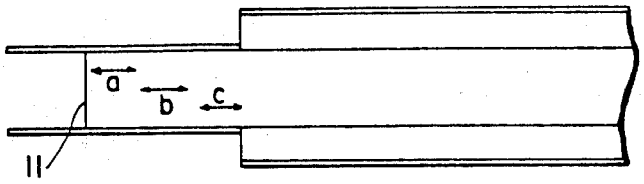

FIG. 5 is a longitudinal section of a junction in which the dielectric is cut at right angles to the longitudinal axis rather than shaped into a cone. The dielectric is fabricated to have an increasing specific gravity from end 11 progressing to the right as indicated by the letters a, b and c. The adjustment of specific gravity is achieved by multi-step stretching and heating or controlled focusing of infrared or far-infrared rays.

A junction having a structure combining the embodiments of FIG. 4 and FIG. 5 is possible, and other shaped junctions will be readily available to one skilled in the art.

The dielectric waveguide and/or junction of the present invention has many advantages including:

1. Low transmission loss due to the small tan $\delta$ and the absence of foaming agent in the dielectric material, e.g., tan $\delta$ of expanded PTFE with a density of 0.2 g/cm is approximately 1/10 that of solid PTFE.
2. The dielectric constant of the waveguide can be uniformly controlled over a wide range.
3. Electromagnetic waves having a high energy density can be transmitted.
4. The shape and structure of the dielectric is easily controlled.
5. The invention waveguide is highly flexible.
6. The inventive waveguide is very insulative to heat over a wide temperature range. The most remarkable example thereof is the use in a cryogenic environment and signal transmission between cryogenic and room temperature environments.

The following examples are intended to illustrate but not limit the present invention.

EXAMPLE I

Following the teachings of U.S. Pat. No. 3,953,566 a PTFE rod is expanded at a stretch ratio of 6:1. The resulting rod has a specific gravity of 0.37, a relative permittivity of 1.3 and an outside diameter of 9 mm.

The rod is cut to a length 1 m to give a dielectric waveguide.

From one end of the waveguide an electromagnetic wave at a frequency of 100 GHz was sent lengthwise into the waveguide by means of a conical horn. The attenuation was measured at the other end as 0.2 dB/m. This value was lower than that of solid PTFE, formerly considered the best with an attenuation of 2.7 dB/m. The rod of this example can be used for the transmission of milli-waves.

EXAMPLE II

The expanded rod of Example I was spirally wrapped, in an overlapping mode, with an expanded porous PTFE tape, measuring 0.2 mm in thickness, 20 mm in width and having a specific gravity of 0.26. The resulting composite had an outside diameter of 15 mm. For the purpose of absorbing electromagnetic waves and physical reinforcement the wrapped composite tube is then covered with an extruded PVC jacket, 1 mm thick, to give a dielectric waveguide as shown in FIG. 2. This waveguide, 1 m in length had an attenuation of 0.3 dB/m.

EXAMPLE III

Both ends of the dielectric waveguide of Example I were reheated and stretched 3 times to give a core dielectric. Referring to FIG. 5, area a has a specific gravity of 0.1; b 0.2; and c 0.3.

This core was then wrapped, leaving a 27 mm portion at each end, with an expanded PTFE tape to an outside diameter of 15 mm and covered with a 1 mm extruded PVC jacket. The 27 mm portions were not wrapped or jacketed, being reserved for connection with a metal waveguide.

The resultant waveguide, 1 m in length, was connected on both ends to metal waveguides and its effectiveness as a junction confirmed.

The dielectric waveguide and/or junction utilizing a porous crystalline polymer with a microstructure of nodes interconnected by fibrils.

I claim:

1. A method for the transmission of electromagnetic waves comprising transmitting said waves using a dielectric waveguide wherein said waveguide comprises a shaped article of porous PTFE having a specific gravity between about 1.45 and about 1.9.

2. The method of claim 1 in which said shaped article is unsintered PTFE in the form of a rod.

3. The method of claim 1 in which said shaped article is partially sintered PTFE in the form of a rod.

4. A dielectric waveguide for the transmission of electromagnetic waves comprising an elongated shaped article having one or more layers of expanded, porous polytetrafluoroethylene extending radially outwardly from the center of said waveguide.

5. The dielectric waveguide of claim 4 in which the specific gravity of said layers varies in a stepwise fashion from the innermost layer to the outermost layer.

6. The dielectric waveguide of claim 4 in which the specific gravity of said layers varies in a continuous fashion from the innermost to the outermost layer.

7. The dielectric waveguide of claim 4, 5 or 6 in which said expanded polytetrafluoroethylene is unsintered.

8. The dielectric waveguide of claim 4, 5 or 6 in which said expanded polytetrafluoroethylene is partially sintered.

9. The dielectric waveguide of claim 4, 5 or 6 in which said expanded polytetrafluoroethylene is fully sintered.

10. The dielectric waveguide of claim 4, 5 or 6 in which said layers of expanded polytetrafluoroethylene include a combination of unsintered, partially sintered and fully sintered expanded polytetrafluoroethylene.

11. A dielectric waveguide for the transmission of electromagnetic waves comprising a shaped article having: (a) a core of polytetrafluoroethylene; and (b) one or more layers of expanded, porous polytetrafluoroethylene overwrapped on or around said core.

12. The dielectric waveguide of claim 11 in which the specific gravity of substantially all or all of said layers is lower than the specific gravity of said core.

13. The dielectric waveguide of claim 11 in which the specific gravity of said core is less than about 1.9.

14. The dielectric waveguide of claim 11 in which the specific gravity of said layers varies in a stepwise fashion from the innermost layer to the outermost layer.

15. The dielectric waveguide of claim 11 in which the specific gravity of said layers varies in a continuous fashion from the innermost to the outermost layer.

16. The dielectric waveguide of claims 11, 12, 13, 14 or 15 in which said shaped article is in the form of a rod.

17. The dielectric waveguide of claims 11, 12, 13, 14 or 15 in which said core is expanded, porous polytetrafluoroethylene.

18. The dielectric waveguide of claim 4 or 11 which is covered with a metal jacket.

19. The dielectric waveguide of claim 4 or 11 which is covered with a PVC jacket.

20. The dielectric waveguide of claim 1 and/or a junction therefor comprising unsintered or partially sintered PTFE, the dielectric constant of said waveguide and/or junction being changed in the longitudinal direction thereof.

21. The product of claim 20 in which the dielectric constant changes in a stepwise fashion in the longitudinal direction thereof.

* * * * *

UNITED STATES PATENT AND TRADEMARK OFFICE

CERTIFICATE OF CORRECTION

PATENT NO. : 4,463,329

DATED : July 31, 1984

INVENTOR(S) : Hirosuke Suzuki

It is certified that error appears in the above-identified patent and that said Letters Patent is hereby corrected as shown below:

In column 3, line 68, "Er (at 10 Hz)" should read:

--$\epsilon_r$ (at $10^6$ Hz)--

Signed and Sealed this

*Twenty-sixth* Day of *February 1985*

[SEAL]

*Attest:*

DONALD J. QUIGG

*Attesting Officer*

*Acting Commissioner of Patents and Trademarks*